United States Patent [19]

Pozsgay et al.

[11] 3,982,416

[45] Sept. 28, 1976

[54] INDEXING WEDGE DRIVE FOR COLD TUBE REDUCING MILLS AND THE LIKE

[75] Inventors: Dezsoe Albert Pozsgay, Pittsburgh; William R. Scheib, Sewickley, both of Pa.

[73] Assignee: Aetna-Standard Engineering Company, Ellwood City, Pa.

[22] Filed: Nov. 19, 1975

[21] Appl. No.: 633,483

[52] U.S. Cl. ..... 72/214; 72/249

[51] Int. Cl.[2] ..... B21B 21/00

[58] Field of Search ..... 72/214, 208, 209, 193, 72/189, 249

[56] References Cited

UNITED STATES PATENTS

| | | | |
|---|---|---|---|
| 3,211,027 | 10/1965 | Krause | 72/208 |
| 3,411,336 | 11/1968 | Wadleck | 72/209 X |

*Primary Examiner*—Milton S. Mehr

*Attorney, Agent, or Firm*—Mandeville and Schweitzer

[57] ABSTRACT

The invention is directed to a wedge actuating drive for reciprocating cold reducing tube mills. The wedge drive is driven in common with the main crank which reciprocates the roll carriage, so as to be synchronized therewith. Upper and lower roll positioning wedges are arranged to be cyclicly inserted in and withdrawn from roll-closing positions, by means of eccentric drive shaft means associated with each of the wedges, one above and one below the pass line for the workpieces.

Indexing drive means is provided for the eccentric shaft means, whereby during continuous rotation of the main drive shaft for the system, the eccentric drive shaft means for the wedges are actuated intermittently, so that wedge actuation occurs, as desired, only during the periods when the crank-driven roll carriage nears the end extremities of its reciprocating stroke.

The use of an indexing drive means, rather than more conventional cam and toggle means, provides significantly greater long-term reliability in the operation of the roll positioning wedges, and enables significant reductions to be achieved in the construction cost of the equipment. At the same time, significantly higher operating speeds may be obtained.

6 Claims, 4 Drawing Figures

INDEXING WEDGE DRIVE FOR COLD TUBE REDUCING MILLS AND THE LIKE

BACKGROUND AND SUMMARY OF THE INVENTION

In a typical multi-strand, reciprocating cold tube reducing mill or the like, there is conventionally provided a large, heavy mill housing, which forms a tunnel-like opening disposed along the desired pass line of the work. A roll carriage is located in said tunnel-like opening and is arranged, by means of an extremely heavy duty crank drive, to be reciprocated in the direction of the pass line axis. The roll carriage mounts a pair of reducing rolls, typically in a four-high arrangement, with the backing rolls engaging the upper and lower walls of the main housing. A stock reducing operation commences with the roll carriage in an upstream position, being drawn in a downstream direction by means of the main driving crank. The working rolls and the backing rolls are geared together, and the backing rolls are connected by a rack to the main housing, so that movement of the carriage results in positive, synchronous rotation of the working rolls over the stock. In a single operating stroke, the tapered grooves of the working rolls serve to reduce a limited length of the workpiece to the desired dimensions, whereupon the working rolls are opened up and the roll carriage is reciprocated back in an upstream direction, without working contact with the stock, to commence a new operating stroke.

To enable the working rolls to disengage the stock, in preparation for a return stroke, positioning wedges are provided above and below the backing plates for the respective upper and lower working rolls. At the commencement of the return stroke, these wedges are withdrawn, releasing the backing plates and permitting limited separation of the working rolls. As will be understood, the manipulation of the backing wedges must be timed with the movements of the carriage, such that the wedges are withdrawn near the downstream end of the crank movement, and reinserted into operating position at the upstream end of the crank stroke. Heretofore, it has been conventional to utilize heavy cam and toggle arrangements for this purpose. These mechanisms, although serviceable, present certain problems with respect to the frequency of maintenance and repair, and also impose certain limitations upon the speed of operation of the system as a whole.

As a basic objective of the invention, a new and improved wedge drive system is provided, which enables the roll positioning wedges to be operated synchronously with the main drive crank but in an intermittent manner, providing a reliable and effective, low maintenance drive system, which is less expensive to construct and maintain than a conventional mechanism and yet which permits higher operating speeds to be realized in the system as a whole. More specifically, in this connection, the movable positioning wedges are arranged to be retracted from and inserted into roll backing position by means of individual rotary eccentric shaft means for each wedge, these individual eccentric shafts are provided with rugged support bearings, to withstand the forces necessary to extract and reinsert the roll backing wedges.

As another significant feature of the invention, the eccentric drive shafts for the roll backing wedges are arranged to be driven through a Geneva-like index drive, the input to which is a constant rotation, as a function of the main drive system, whereas the output is an intermittent rotation, limited both as to angle of rotation and as to time. Thus, at the end of the downstream stroke of the main drive crank, the intermittent drive mechanism functions to rotate the wedge drive eccentrics through one half revolution, to extract the roll positioning wedges and permit separation of the rolls. As the roll carriage is returned to the upstream limit position, a further operation of the indexing drive occurs, to rotate the eccentric shafts through a second one half revolution, to reinsert the roll positioning wedges into their operating positions. The use of an intermittently indexing drive, operated directly from the main crank drive, greatly simplifies the mechanisms of the wedge drive, enabling simpler, more rugged wedge drives to be provided at lower cost than conventional mechanisms.

For a better understanding of the above and other features and advantages of the invention, reference should be made to the following detailed description and to the accompanying drawings.

DESCRIPTION OF A PREFERRED EMBODIMENT OF THE INVENTION

Figure 1:
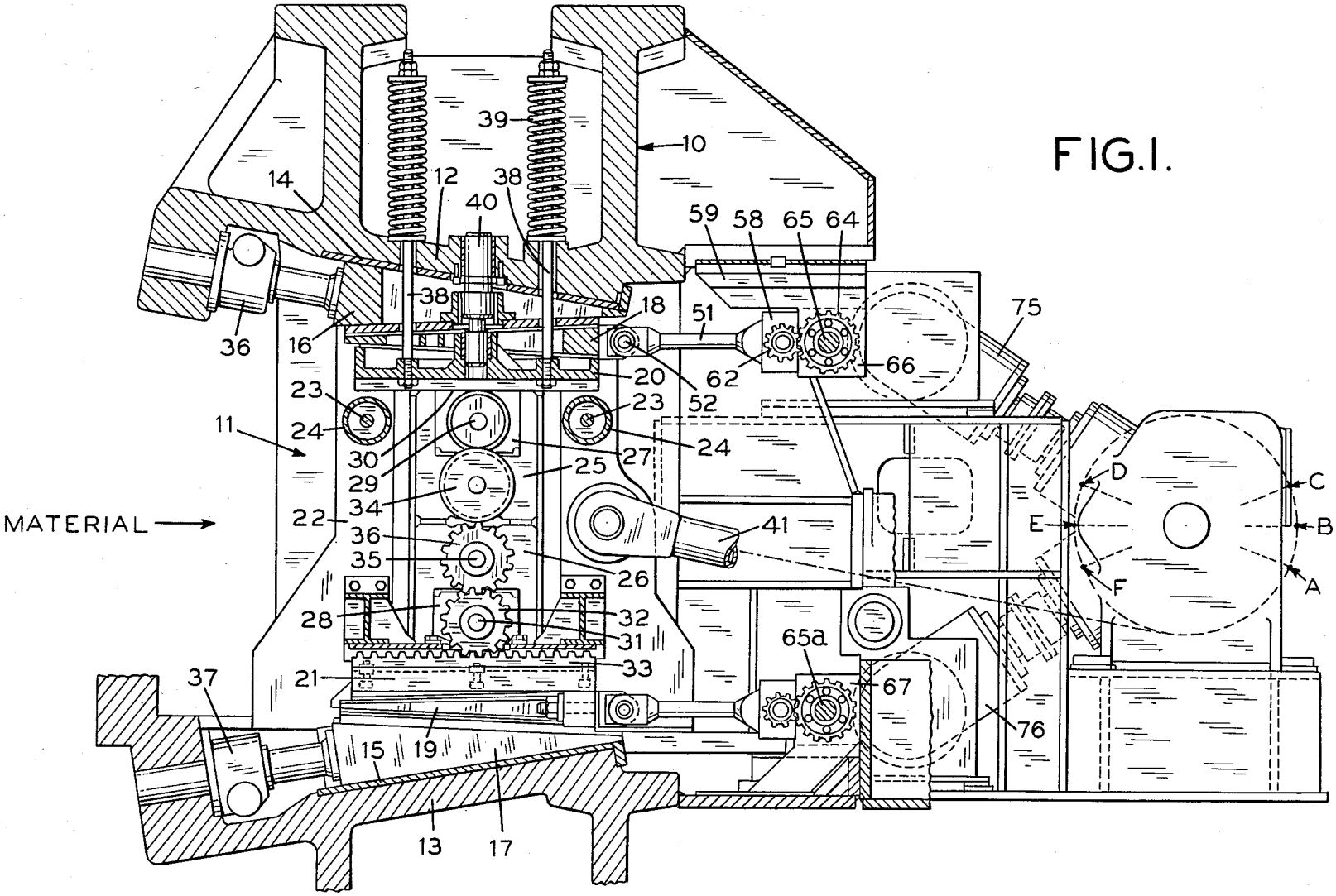
FIG. 1 is a longitudinal, cross sectional view of a cold tube reducing mill incorporating the wedge drive arrangement of the invention, the upper portion of the mill being shown along a deeper section than the lower portion.

Referring now to the drawings, and initially to FIG. 1, the mill includes a main frame housing structure 10, which may be a heavy casting or weldment, provided with a tunnel-like opening 11 therein. The upper and lower surfaces 12, 13 of the frame opening are disposed at the considerable angle to the pass line, and are provided with bearing surfaces 14, 15, to receive and support adjustable primary positioning wedges 16, 17. Secondary positioning wedges 18, 19 are arranged to operate in conjunction with the primary wedges 16, 17 to support roll backing plates 20, 21, defining the upper and lower working surfaces of the mill housing as will appear. Mounted within the housing opening 11, for limited reciprocating movement in a horizontal direction, are spaced roll carriage housings 22, which are rigidly connected together by means including tie rods 23 and spacers 24. The carriage housings slideably mount working roll bearings 25, 26, and the working roll bearings in turn slideably support backing roll bearings 27, 28.

As reflected in the illustration of the upper portion of the roll carriage, the upper backing roll 29 is arranged to bear against the downwardly facing surface 30 of the upper backing plate 20. A similar arrangement prevails at the bottom of the roll carriage. Likewise, as is illustrated in the lower portion of the carriage, the lower backing roll 31 mounts a gear 32 arranged to mesh with a rack 33 mounted on the lower backing plate 21. A similar driving arrangement is provided for the upper backing roll 29, as will be understood. The described arrangement, which is conventional, is such that, with the upper and lower backing plates 20, 21 positioned and supported by the primary and secondary wedges, the working rolls 34, 35 are supported in operative, rolling positions by the backing rolls 29, 31. In addition, when the roll carriage 22 is reciprocated in the frame window 11, the working rolls are rotated at a predetermined rotational speed in relation to their bodily advancement with the carriage, by means of the rack-driven gears 32, which mesh with gears 36 carried by the working rolls 34, 35, similar driving arrangements being provided for the upper and lower working and backing rolls, as will be understood.

In the arrangement shown in FIG. 1, the working positions of the backing plates 20, 21, assuming the removable secondary wedges 18, 19 to be in their respective working positions, is determined by precise positioning of the primary wedges 16, 14. This is accomplished by means of screw drives 36, 37, which are normally fixed but can be adjusted from time to time to accommodate changes in the working rolls, and/or the workpiece specifications.

Assuming the primary wedges 16, 17 to be properly adjusted, the backing plates 20, 21 are held in the desired working positions by insertion of the secondary wedges 18, 19 in predetermined working positions, between the primary wedges and the backing plates. When the secondary wedges are so positioned, the relationship of the backing plates, backing rolls and working rolls is such as to enable the work to be reduced in the desired manner. Separation of the rolls may be effected by withdrawing the secondary wedges 18, 19, by pulling them to the right, or in a downstream direction as illustrated in FIG. 1, through a limited stroke, sufficient to relieve the pressure between the working rolls.

In the arrangement illustrated in FIG. 1, the upper backing plate 20 is shown to be supported by means of a plurality of tie rods 38, which are urged upwardly by heavy springs 39. Thus, when the wedge 18 is withdrawn, the heavy springs 39 urge the backing plate 20 upwardly to relieve the pressure of the backing roll 29. Desirably, guide pin means 40 are provided, connecting the frame 10 to the backing plate 20, to maintain the backing plate accurately positioned in fixed alignment in the main frame 10, while the roll carriage 22 is driven through its reciprocating movements. It will be understood of course, that the lower backing plate 21 is mounted and carried in a manner similar to that illustrated and described with respect to the upper backing plate 20.

The mill and carriage arrangement as just described is substantially conventional, and the carriage is conventionally arranged to be driven through a succession of limited reciprocating strokes, by means of a crank 41, driven by a continuously rotating main crank shaft (not shown). When the mill is in operation, the roll carriage is reciprocated in an upstream direction with the secondary wedges 18, 19 withdrawn to permit a slight separation of the working rolls 34, 35. While this is happening, the stock is being incrementally advanced in a downstream direction, in preparation for a new rolling cycle.

As the roll carriage 22 reaches the end of its return stroke, the secondary wedges 18, 19 are driven home, bringing the working rolls 34, 35 back into closed position on the workpiece. Immediately thereafter, the carriage is reciprocated in a downstream direction, with the working rolls rolling progressively along the workpiece, and the tapered grooves of the rolls effecting progressive reduction of the stock in the manner desired. When the carriage 22 approaches the downstream limit of stroke, the wedges 18, 19 are suddenly withdrawn, permitting the backing plates 20, 21 to retract, and the cycle continues repetitively, operating to reduce the stock in progressive increments in a known manner.

Figure 3:
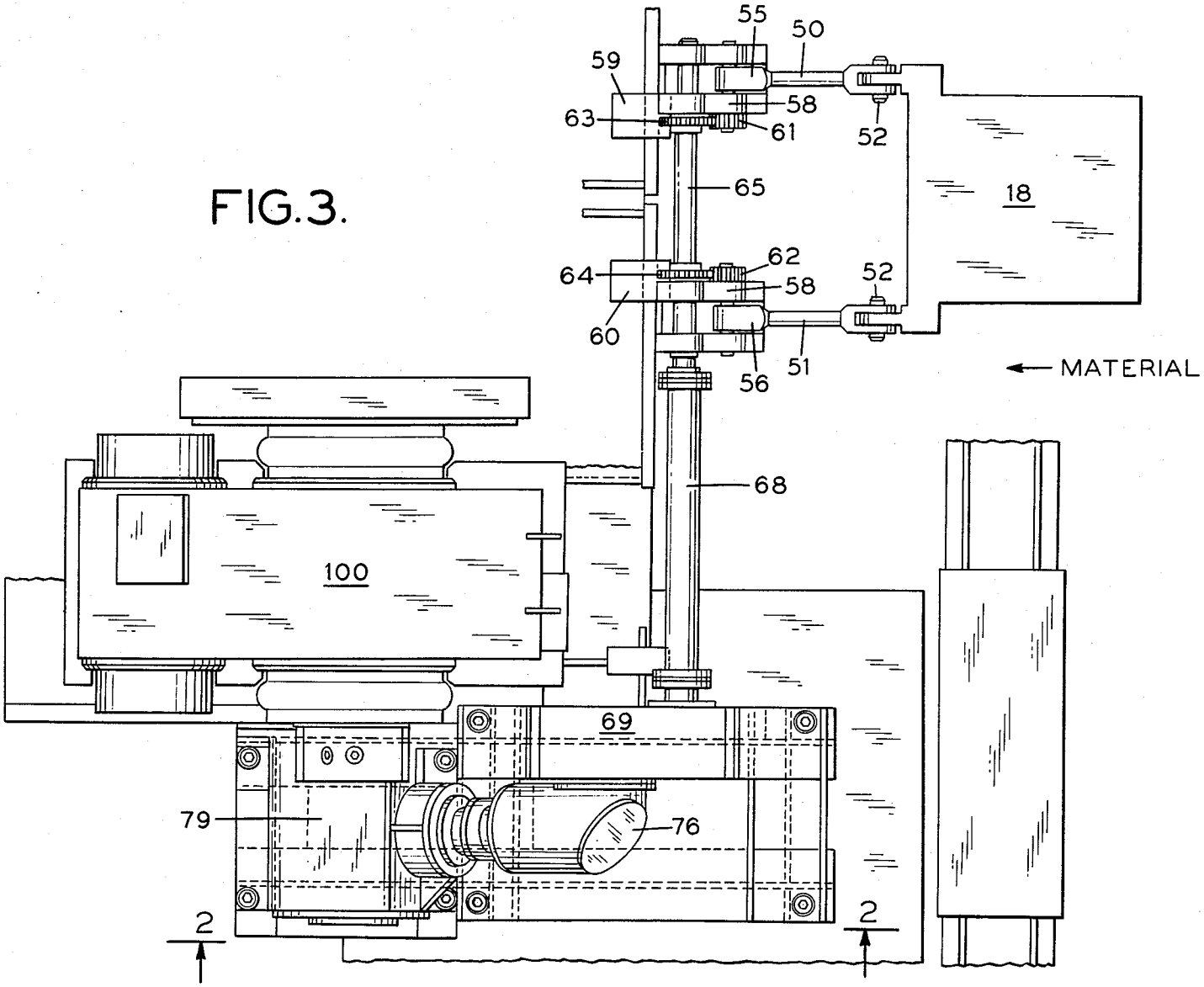
FIG. 3 is a top plan view of the wedge drive mechanism utilized in the mill of FIG. 1.
Figure 4:
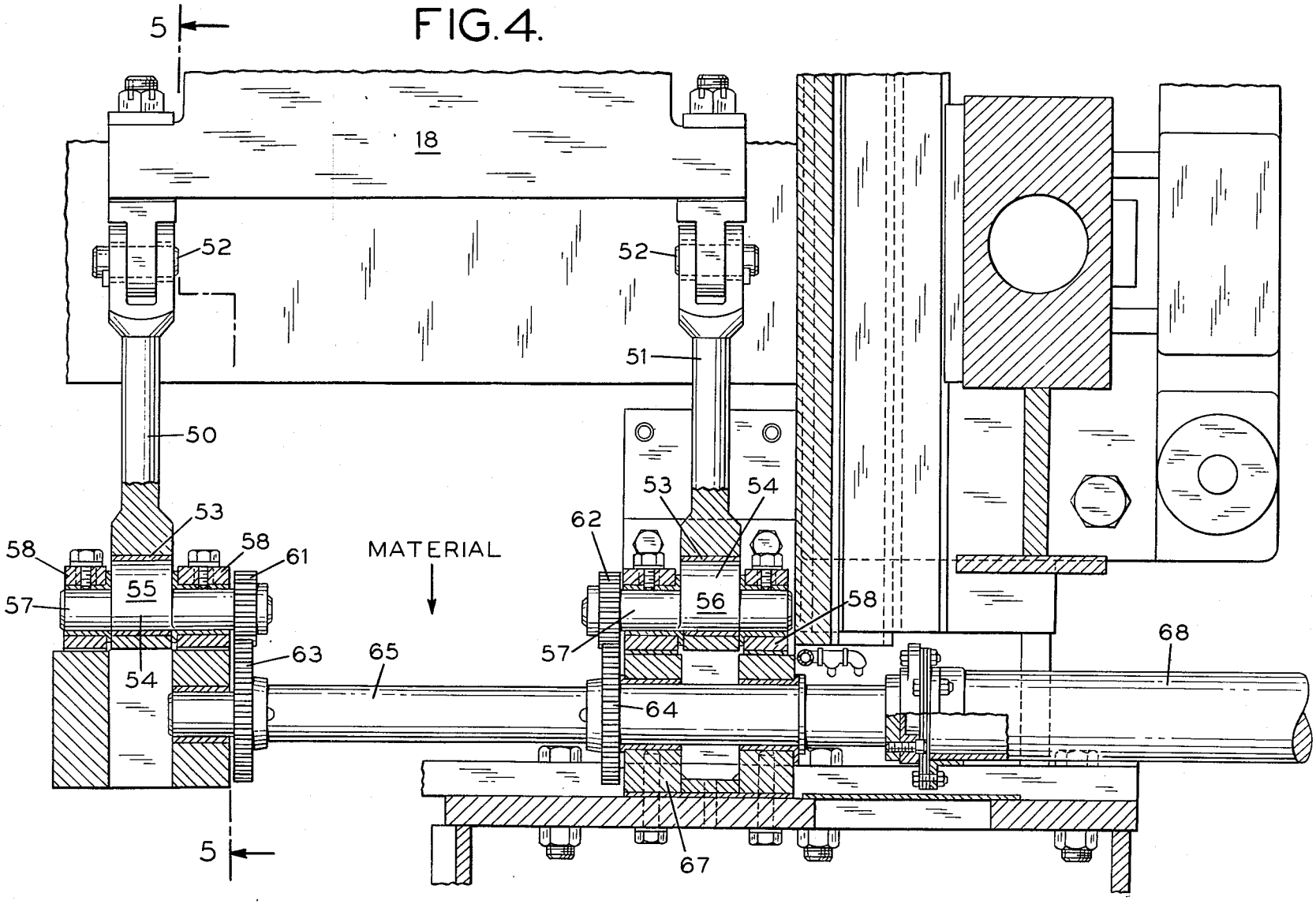
FIG. 4 is an enlarged, fragmentary view of the wedge drive mechanism shown in FIG. 3, with parts broken away to illustrate details of the construction.

Pursuant to the invention, each of the retractable, secondary positioning wedges 18, 19 is connected at its opposite side extremities to a pair of connecting links 50, 51 (see FIGS. 3 and 4). Pivot pins 52 join the links 50, 51 with the wedges in a manner to accommodate limited pivoting movement. At their outer or downstream ends, the connecting links 50, 51 are provided with bearings 53 which rotatably receive cylindrical, eccentric portions 54 of eccentric drive shafts 55, 56. The eccentric shafts 55, 56 include journal portions 57, which are mounted in rigid bearings 58 for rotation about axes offset a predetermined distance from the geometric centers of the cylindrical eccentric portions 54. The amount of offset of eccentricity of the shaft portions 54 is equal to one half of the overall operating stroke of the secondary positioning wedges 18, such that the full operating displacement of the connecting links 50, 51 and positioning wedges 18, 19 may be realized by 180° of rotational displacement of the eccentric shafts 55, 56.

As reflected in FIG. 1, the bearings 58 for the eccentric shafts 55, 56 are rigidly secured to the mill frame structure, as at 59, 60, to provide a firm and rugged support for the eccentric wedge drive shafts. In addition, the eccentric shafts 55, 56 desirably are mounted on a common axis, substantially aligned with the plane of movement of the respective secondary wedges 18, 19 with which the shafts are associated, such that the working forces applied through the connecting links 50, 51 are substantially aligned with the planes of motion of the respective wedges.

The eccentric wedge driving shafts 55, 56 for each wedge are provided at one end with drive pinions 61, 62, and these pinions mesh with drive gears 63, 64 respectively, fixed to upper and lower indexing shafts **65, 65*a*. The shafts 65, 65*a* are journaled in heavy bearings 66, 67, secured to the main mill frame. As reflected particularly in FIG. 1, the upper shaft 65 extends transversely of the mill, above the pass line of the stock, while the lower shaft 65*a* extends across the mill below the pass of the stock. The shafts 65, 65*a* are also respectively above and below the envelope within which the main connecting rods 41 operate in the course of the reciprocating movements of the roll carriage 22.**

Figure 2:
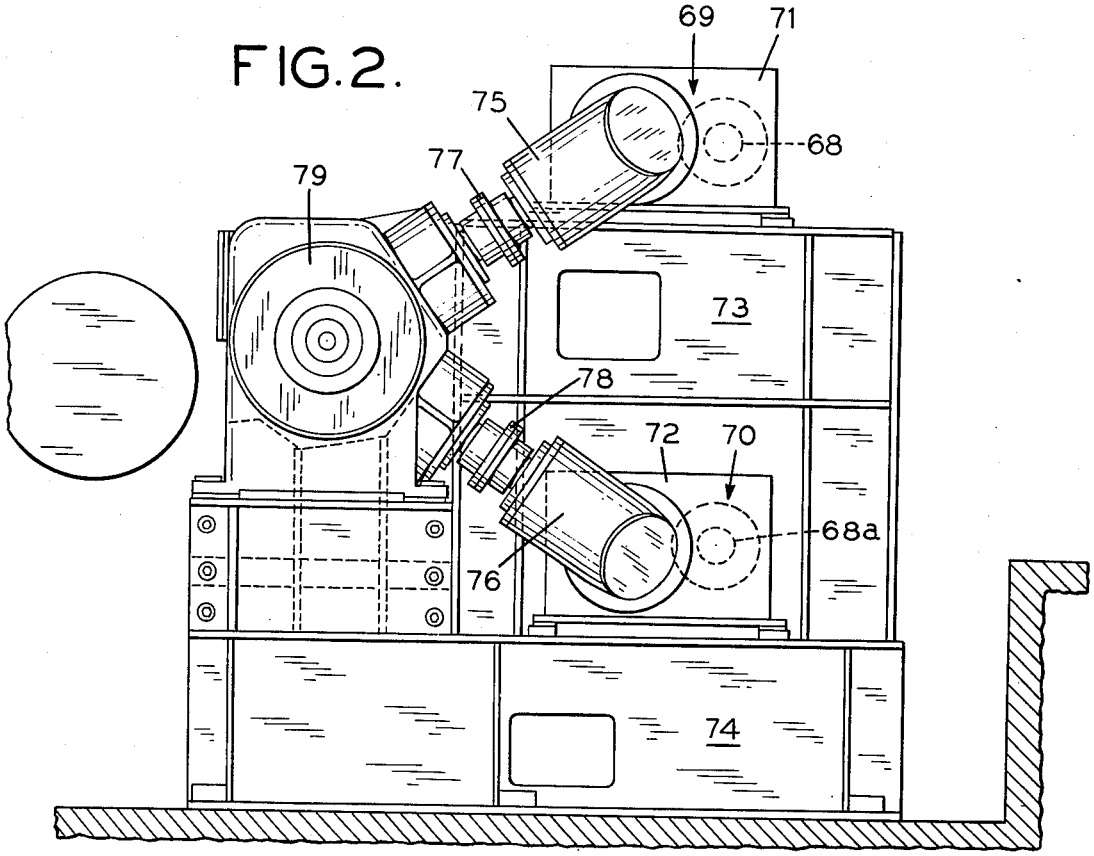
FIG. 2 is a back elevational view of the mill of FIG. 1.
Figure 5:
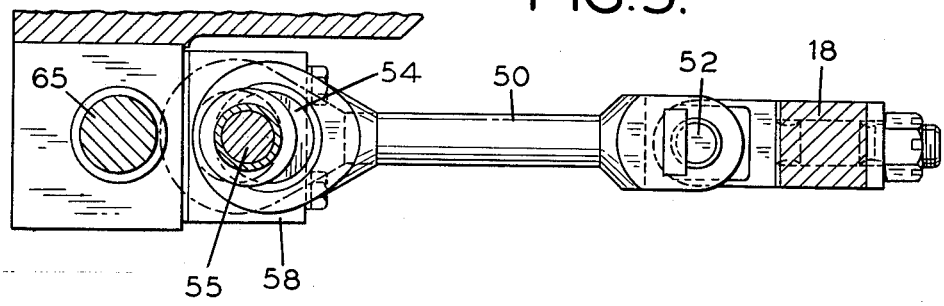
FIG. 5 is a cross sectional view as taken generally on line 5—5 of FIG. 4.

As reflected best in FIG. 3, the indexing shafts **65, 65*a* are provided with lateral extensions 68, 68*a* connected respectively to the output sides of indexing gear mechanisms 69, 70. Insofar as is reflected in FIGS. 2 and 3, the indexing drives 69, 70 are housed in generally retangular boxes 71, 72, mounted on frame members 73, 74 respectively, which are fixed in relation to the basic mill frame 10.**

The indexing drives 69, 70, to be described in further detail, are connected at their input sides with 90° angle gear boxes 75, 76, and the inputs 77, 78 respectively of these angle gear boxes are directed respectively downward and upward, connecting with dual outputs of a main gear drive 79. Although the details of most of the drive components are omitted herein, as being readily understandable to those skilled in the art, it is to be noted that the main wedge drive box 79 is connected to (or at least synchronized with) the continuously rotating main drive 100 for the mill crank, such that there is a continuous rotary input to the indexing drives 69, 70, which is synchronized with the reciprocations of the roll carriage 22.

Figure 6:
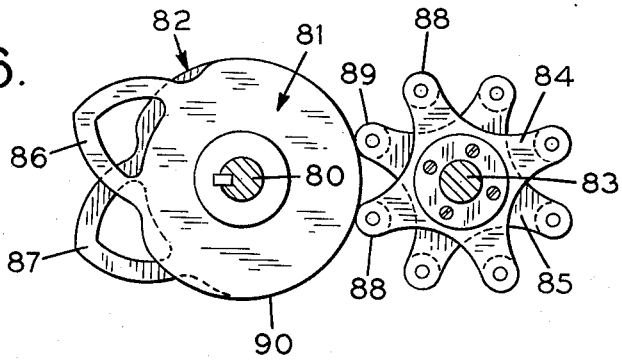
FIG. 6 is a schematic representation of the indexing drive mechanism utilized to convert the continuous rotating input from the main drive system to an intermittent, limited rotation output of the indexing drive.

To greatest advantage, the indexing drives 69, 70 are of a type which is commercially available under the trade description "Camco Parallel Index Drive", manufactured by Commercial Cam & Machine Co., of Chicago, Ill. Such an index drive is schematically illustrated in FIG. 6, showing a drive input shaft 80, mounting parallel cams 81, 82, and an output shaft 83, carrying parallel index wheels 84, 85. In the illustrated arrangement, each of the input cams 81, 82 has a cam lobe 86 or 87 which covers about 60° or one sixth of its circumference. In addition, the lobes 86, 87 of the respective cams are offset approximately 30°.

In conjunction with the drive cams 81, 82, the indexing wheels 84, 85 are each provided with four sets of follower wheels 88, 89. The follower elements of each index wheel are displaced 90° apart, and the respective indexing wheels themselves are displaced 45° from each other.

With the indexing mechanism in an intermediate position, as shown in FIG. 6, follower elements 88, 89 from each index wheel are in contact with the cylindrical outer surface portions 90 of the respective drive cams 81, 82, locking the index wheels against rotation. Assuming the cams to be rotating in a clockwise direction, the lobe 86 of the cam 81 will engage a follower element 88, displacing the index wheel 84 in a counterclockwise direction through an angle of 45°. The adjacent index wheel 85, being rigidly associated with the wheel 84, is of course also displaced through an angle of 45°. As the first lobe 86 moves out of contact with its follower 88, the adjacent or parallel lobe 87 makes contact with the second follower wheel 89, effecting a similar and further displacement of 45°, counterclockwise, of the index wheel assembly 84–85. After the second lobe has passed through the working area, the index wheels will have been displaced through 90°, and the next set of follower elements 88, 89 will engage the cylindrical outer surface area of the cams, such that the index wheel is held fixed against further rotation.

Desirably, the overlapping relationship of the cam lobes 86, 87 is such that the described 90° of indexing movement of the wheel assembly 84–85 is achieved in about 90° of rotation of the input drive shaft 80. During the remaining 270° of rotation, the index wheels remain fixed.

In the arrangement of the invention, the drive gears 63, 64, carried by the index shafts 65, 65*a*, have a two-to-one relationship with the eccentric shaft pinions 61, 62. Accordingly, for each 90° of indexing movement of the indexing output shaft 83, there is a full 180° rotation of the eccentric shafts 55, 56, to effect a complete withdrawing movement or a complete inserting movement of the secondary positioning wedges 18, 19, as the case may be. Thus, the drive synchronization of the input to the index drive shaft 80 is such that the shaft 80 makes two complete revolutions for each complete working cycle of the roll carriage 22. Further, the indexing output of the drives 69, 70 is confined to a relatively small percentage of the overall cycle, being achieved during about 90° of rotation of the input shaft 80, with no movement occurring during the remaining 270° of rotation. Thus, by properly synchronizing the drive to the index input shaft 80 with the main crank drive for the roll carriage 22, the indexing drive will commence to have an output motion as the main drive crank enters a 45° segment of rotation at either extremity of its stroke — that is, about 22½° on either side of its dead center positions at both ends.

With the apparatus thus described, as the main drive crank approaches its downstream dead center position, reaching the point designated A in FIG. 1, the index drives 69, 70 will have reached a point in their operating cycles where the lobes 86 are making initial engagement with the follower wheels 88, commencing an indexing movement. As the main crank continues through a total of about 45° of additional rotation, from the position A, through the dead center position B and to the position C, the indexer input 80, operating at double the speed of the crank, is driven through a rotation of 90°, effecting a 90° output rotation of the indexer output shaft 83. This in turn results in a full 180° rotation of the eccentric shafts 55, 56, effecting a complete withdrawal of the positioning wedges 18, 19 to release backing pressure from the rolls 34, 35.

As the main crank continues through a further rotation angle of 135°, the indexer input 80 is driven through 270° of rotation, with the indexer output, however, being locked in position by contact of the followers 88 with the circular portions of the cams 81, 82. Then, as the crank nears its upstream dead center position, specifically at the position B shown in FIG. 1, a further indexing output is commenced, with a 90° rotation of the output shaft 83 being effected during the next 45° of rotation of the crank through the upstream dead center position E and over to the position F. During the second 90° indexing output, with the crank at the upstream end of its stroke, the eccentric shafts 55, 56 are driven through a further 180° revolution, moving the positioning wedges 18, 19 forceably back into their working positions, in readiness for a subsequent rolling cycle.

As will be appreciated, the positioning wedges 18, 19 are withdrawn and inserted during the period when the main crank is within approximately 22½° of its dead center position at either end, such that there is minimal motion of the roll carriage during the periods when the positioning wedges 18, 19 are being inserted or withdrawn from working position. The eccentric shafts 55, 56, although providing a highly simplified and rugged control mechanism for the wedges 18, 19, additionally provide a highly desirable system of force application to the wedges, since extremely high mechanical advantage is achieved at the extremities of the wedge movement, to facilitate the initial "break out" of the wedges from their working positions and to effectively force the wedges back into their working positions in preparation for a further cycle. This is achieved by causing the eccentric shafts 55, 56 to be generally aligned in the plane of the wedges, such that the extremities of the wedge movement are realized at the dead center positions of the eccentric shafts.

One of the significant practical advantages of the present invention resides in the fact that each of the wedges 18, 19, is driven at both sides from a common shaft, which extends transversely across the machine, either above or below the pass line. This assures, to the greatest practicable extent, that the working forces acting on the wedge, either to withdraw it or to reinsert it, are substantially equal at opposite sides. By way of contrast, in at least some of the mechanisms presently in use, a common linkage is used at each side of the machine, with each linkage connecting one side of an upper wedge and one side of a lower wedge. With time, and as the bearings and linkages suffer normal wear, the mechanisms at opposite sides of the mill can get slightly out of synchronization, resulting in slightly asymmetrical loading on the wedges. With the present system, even if the upper and lower mechanisms are slightly out of synchronization (which is less likely then to occur than with prior apparatus) the individual wedges will continue to be symmetrically loaded.

With the new indexing drive arrangement, significantly higher operating speeds may be achieved than has been practicable heretofore. For example, in a typical multistrand mill equipped with the new arrangement, a sustained operating speed of 120 strokes per minute may be realized, whereas a typical production speed with prior mechanisms is on the order of 85 strokes per minute. With the new apparatus, in addition to enjoying the significantly greater production speeds indicated, less maintenance is required, because the positive load sharing at opposite sides of each wedge assures reduced operating loads and thus less wear on the mechanism as a whole.

Notwithstanding its significant advantages, the wedge drive described herein is generally of a more simplified nature than prior mechanisms for the same purpose, and thus involves a lower initial manufacturing cost. The new mechanism is also readily adaptable to installation in existing mills, enabling such mills to be converted at reasonable cost from the prior, lower speed wedge drives to enable a higher mill output to be achieved.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. An indexing wedge drive for a cold tube reducing mill or the like, where the mill includes a mill housing forming an opening for receiving workpieces, a movable roll carriage mounted for limited reciprocating movement in said opening, in the direction of the workpiece pass line, carriage drive means including a main crank for reciprocating said carriage, grooved mill rolls in said carriage rotatable in conjunction with and as a function of the reciprocating movement of the carriage, backing plates for supporting said mill rolls, reciprocatable positioning wedges interposed between said backing plates and said mill housing and movable in a first direction to bring the mill rolls into operating positions and in a second direction to accommodate limited separation of the mill rolls, characterized particularly by the provision of improved means for effecting timed reciprocating movement of said wedges, which means comprises, a. input drive shaft means connected to said carriage drive means and rotatable therewith, b. an indexable wedge drive shaft associated with each of said wedges, supported by said housing and extending transversely of the workpiece pass line, one above and one below, adjacent the respective wedges, c. drive links operatively associating each of said wedges with its respective indexable wedge drive shaft, d. means forming an eccentric connection between said drive links and said wedge drive shafts, whereby rotation of the drive shafts through a cyclic increment will reciprocate said wedges out of, or back into, roll closing position, e. index drive means connected to each of said indexable wedge drive shafts and driven by said input drive shaft means, f. said index drive means being synchronized with said drive shaft means and main crank for indexing said wedge drive shafts through a cyclic increment as said main drive crank reaches the end of its stroke in each direction, g. said index drive means holding said wedge drive shafts stationary throughout the principal portion of the operating strokes of said main drive crank.

2. Apparatus according to claim 1, further characterized by a. said index drive means comprising a Geneva-like mechanism adapted to effect its entire indexing output movement during a limited portion of a cyclic increment of an input member, b. said input member being rotatable through a cyclic increment during each half cycle of the main drive crank, to provide an indexing output at each end of the crank stroke, c. said input member being so drivingly related to said main drive crank that said indexing output movement is substantially executed within about 45° of rotation of said main drive crank, near its dead center positions.

3. Apparatus according to claim 1, further characterized by a. said means forming an eccentric connection comprising rotatable eccentric cams, b. said cams and said drive links being aligned substantially in the respective planes of said positioning wedges, c. said eccentric means being rotatable through 180° during each cyclic indexing output, from one dead center position to another.

4. Apparatus according to claim 3, further characterized by a. said eccentric means including individual eccentric shafts connected to each of a plurality of spaced drive links connected to a positioning wedge, b. positive drive means connecting each of the eccentric shafts for a given wedge to a common indexable wedge drive shaft, whereby rotation of a single wedge drive will effect synchronous rotation of the plurality of eccentric shafts.

5. For use in combination with a cold tube reducing mill or the like of the type having a mill housing forming an opening for receiving workpieces, a movable roll carriage mounted for limited reciprocating movement in said opening, in the direction of the workpiece pass line, carriage drive means including a main drive crank for reciprocating said carriage, grooved mill rolls in said carriage, rotatable in conjunction with and as a function of the reciprocating movement of the carriage, backing plates for supporting said mill rolls, reciprocatable wedge means interposed between at least one of said backing plates and said mill housing and movable in a first direction to bring the mill rolls into operating positions and in a second direction to accommodate limited separation of the mill rolls, a new an improved drive mechanism for said positioning wedge, which means comprises, a. a Geneva-like indexing drive means connected to said main drive crank and having an input shaft rotatable in predetermined relation thereto, b. said indexing mechanism having an output shaft rotatable through cyclic increments during a limited portion of a complete cycle of rotation of the input means, c. a wedge drive shaft rotatably mounted in said mill and connected to the output of said index mechanism, for periodic rotation through cyclic increments, d. a plurality of eccentric shafts connected at a plurality of laterally spaced points to said positioning wedge and drivingly associated with said indexable wedge drive shaft, e. said wedge drive shaft and eccentric shafts being so related that, upon a complete cyclic increment of rotation of the wedge drive shaft, said eccentric shafts will effect a full stroke of movement of said positioning wedge, either into or out of working position.

6. The wedge drive mechanism of claim 5, further characterized by a. said eccentric shafts being separate from said indexable wedge drive shaft, b. positive drive means associating said wedge drive shaft and said eccentric shafts, whereby a cyclic increment of rotation of said wedge drive shaft results in 180° of rotation of said eccentric shaft means, from one dead center position to another.

* * * * *